US006213163B1

(12) United States Patent
Wang

(10) Patent No.: US 6,213,163 B1
(45) Date of Patent: Apr. 10, 2001

(54) WEAVING REED DENT SPACING ARRANGEMENTS

(75) Inventor: Pamela C. Wang, Bedford, NH (US)

(73) Assignee: Origitech LLC, Bedford, NH (US)

( * ) Notice: Subject to any disclaimer, the term of this patent is extended or adjusted under 35 U.S.C. 154(b) by 0 days.

(21) Appl. No.: 09/341,951

(22) PCT Filed: Jan. 19, 1998

(86) PCT No.: PCT/US98/00821

§ 371 Date: Sep. 7, 1999

§ 102(e) Date: Sep. 7, 1999

(87) PCT Pub. No.: WO98/31855

PCT Pub. Date: Jul. 23, 1998

Related U.S. Application Data

(60) Provisional application No. 60/035,958, filed on Jan. 21, 1997, and provisional application No. 60/038,066, filed on Feb. 18, 1997.

(51) Int. Cl.[7] ..... D03D 49/62; D03D 49/68

(52) U.S. Cl. ..... 139/192; 139/191; 139/389

(58) Field of Search ..... 139/192, 389, 139/191

(56) References Cited

U.S. PATENT DOCUMENTS

| | | | | |
|---|---|---|---|---|
| 3,470,928 | | 10/1969 | Schwartz | 150/1 |
| 3,705,645 | | 12/1972 | Konen | 206/46 |
| 3,730,551 | | 5/1973 | Sack et al. | 280/150 |
| 3,879,056 | | 4/1975 | Kawashima et al. | 280/150 |
| 3,879,057 | | 4/1975 | Kawashima et al. | 280/150 |
| 3,892,425 | | 7/1975 | Sakairi et al. | 280/150 |
| 3,937,488 | | 2/1976 | Wilson et al. | 280/150 |
| 4,225,642 | | 9/1980 | Hirakawa | 428/91 |
| 4,445,903 | | 5/1984 | Minemura et al. | 8/492 |
| 4,512,374 | * | 4/1985 | Steiner | 139/192 |
| 4,582,747 | | 4/1986 | Hirakawa et al. | 428/229 |
| 4,588,632 | | 5/1986 | Gisbourne et al. | 428/212 |
| 4,649,964 | | 3/1987 | Smith | 139/383 |
| 4,698,276 | | 10/1987 | Duval | 428/116 |
| 4,822,667 | | 4/1989 | Goad et al. | 428/265 |

(List continued on next page.)

FOREIGN PATENT DOCUMENTS

| | | |
|---|---|---|
| 549 264 | 4/1932 | (DE) . |
| 87 14 595 | 1/1988 | (DE) . |
| 334147 | 7/1903 | (FR) . |
| 1103889 | 7/1954 | (FR) . |
| 61-108771 | 5/1986 | (JP) . |

OTHER PUBLICATIONS

Krysiak, H.R., Textile Industries for Jan. 1968, "Close Those Cloth Pores!", pp. 124–131.

Vogt, Horst, Bag & Belt'9, 4$^{th}$ International Akzo Nobel Symposium on Automotive Occupant Restraint Systems,, Apr. 24–26, 1996, "Dynamic Tests to Investigate Airbag Fabric Permeabiity —A New Procedure —", pp. IV/40–IV/55.

*Primary Examiner*—Andy Falik
(74) *Attorney, Agent, or Firm*—Hale and Dorr LLP

(57) ABSTRACT

A weaving reed spacing arrangement having a plurality of reed dents fixed in certain positions and which may be located in a reed baulk. The reeds may be plain reeds or reeds, with any profile, usable virtually on any loom. The dents are formed of wires and spaces and are variably spaced. The variable spaces are formed a number of techniques to produce fabrics with a desired warp density across the entire width of a given fabric. The reed may produce a consistent warp end density which improves the mechanical properties of a given fabric and also provides virtually consistent air permeability across the width of the finished fabrics. The reed can also produce changes in warp end density in a given fabric for certain desired effects. A rotary type reed and weaving rotor for multiple-shed looms are also disclosed.

11 Claims, 12 Drawing Sheets

U.S. PATENT DOCUMENTS

| | | | | |
|---|---|---|---|---|
| 4,872,276 | | 10/1989 | Godfrey | 38/101 |
| 4,977,016 | | 12/1990 | Thornton et al. | 428/225 |
| 5,029,617 | | 7/1991 | Anderson et al. | 139/192 |
| 5,073,418 | | 12/1991 | Thornton et al. | 428/34.9 |
| 5,104,727 | | 4/1992 | Wnenchak | 428/285 |
| 5,110,666 | | 5/1992 | Menzel et al. | 428/196 |
| 5,114,180 | | 5/1992 | Kami et al. | 280/743 |
| 5,131,434 | * | 7/1992 | Krummheurer et al. | 139/389 |
| 5,158,116 | * | 10/1992 | Kazuo et al. | 139/192 |
| 5,208,097 | | 5/1993 | Honma et al. | 428/266 |
| 5,236,775 | | 8/1993 | Swoboda et al. | 428/225 |
| 5,254,398 | | 10/1993 | Gaisser | 428/255 |
| 5,254,621 | | 10/1993 | Inoue et al. | 524/837 |
| 5,258,211 | | 11/1993 | Momii et al. | 428/35.2 |
| 5,277,966 | | 1/1994 | Nakayama et al. | 428/225 |
| 5,296,278 | | 3/1994 | Nishimura et al. | 428/36.1 |
| 5,302,432 | | 4/1994 | Shigeta et al. | 428/36.1 |
| 5,356,680 | | 10/1994 | Krummheuer et al. | 428/36.1 |
| 5,368,076 | | 11/1994 | Curzio | 139/305 |
| 5,375,878 | | 12/1994 | Ellerbrok | 280/743 |
| 5,397,627 | | 3/1995 | Dunbar et al. | 428/229 |
| 5,399,402 | | 3/1995 | Inoue et al. | 428/35.7 |
| 5,465,762 | | 11/1995 | Farley | 139/192 |
| 5,474,836 | | 12/1995 | Nishimura et al. | 428/229 |
| 5,477,890 | | 12/1995 | Krummheuer et al. | 139/291 |
| 5,508,073 | | 4/1996 | Krummheuer et al. | 428/35.1 |
| 5,529,837 | | 6/1996 | Fujiki et al. | 428/266 |
| 5,542,703 | | 8/1996 | Beasley | 280/739 |
| 5,566,434 | | 10/1996 | Beasley | 28/112 |
| 5,566,972 | | 10/1996 | Yoshida et al. | 280/728.2 |
| 5,570,725 | * | 11/1996 | Musha et al. | 139/192 |

* cited by examiner

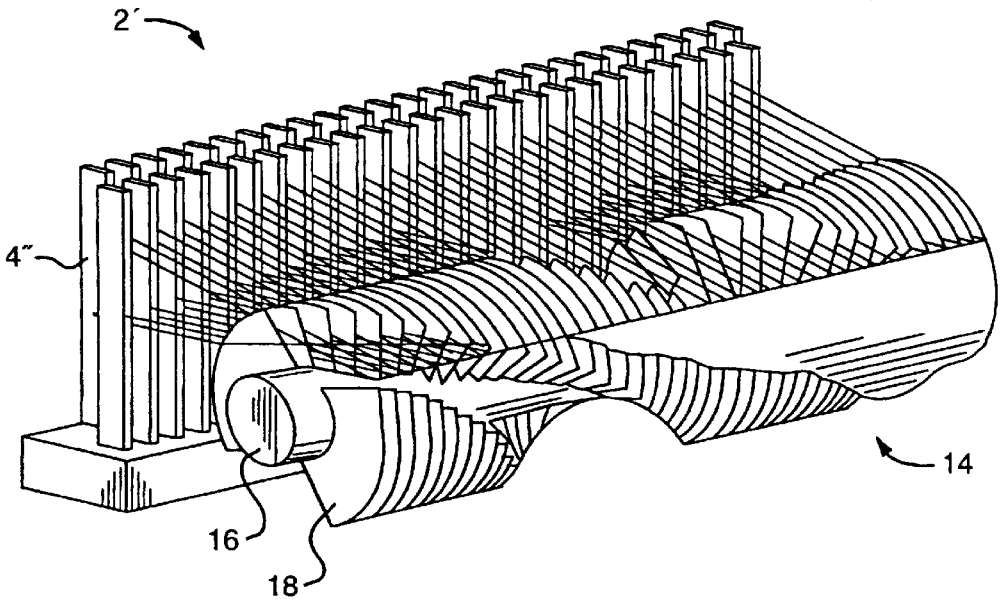
FIG. 19
FIG. 20
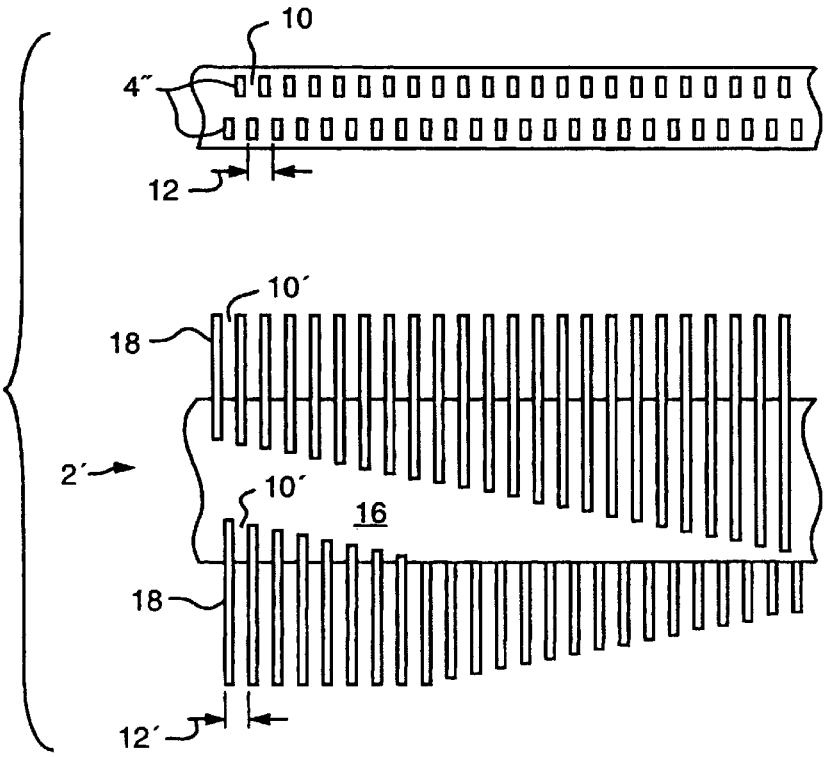

WEAVING REED DENT SPACING ARRANGEMENTS

CROSS REFERENCE TO RELATED APPLICATIONS

This application claims the benefit of U.S. Provisional Application Ser. Nos. 60/035,958, filed on Jan. 21, 1997; and 60/038,066, filed on Feb. 18, 1997.

INTRODUCTION

The present invention is directed to fabric weaving devices, and, more particularly, to fabric weaving devices and methods for producing fabrics having predetermined air permeability.

BACKGROUND OF THE INVENTION

Conventional weaving reeds, rotors and functional equivalents having fixed dent spacing produce finished fabrics with variable warp end density across the entire width of the fabric excluding any possible special selvedge. Most fabrics have different variations in warp end density across the width of finished fabrics due to different yarns and processes. In the case of air bag fabrics, there may be less or more warp end density towards the fabric's edge. In the case of lesser density toward the fabric edge, this is caused by the weaving and finishing processes in which the fabric's edges will be stretched out more than the middle part of the fabric due to tension and heat. As a result of these factors, the density of the finished fabric varies across its width and, consequently, the center of the fabric is more dense. This difference in density can be viewed by studying the finished fabric. Such a finished fabric has a density curve, that is, warp end density as measured in ends/inch, with an inverted U shape as depicted in FIG. 2, where a greater density exists at the center of the finished fabric. The actual warp end density varies across the width of the fabric from the left (L), through the left center (LC), center (C), right center (RC), and to the right (R) portions of the fabric. Some fabrics, in particular, certain of those produced for paper making processes, are subject to different processing conditions which result in a density curve opposite to that of the typical fabric previously discussed. Typically, the edges of these finished paper making fabrics are more dense than the middle.

This variation in warp end density across the entire width of a fabric will affect the mechanical properties of the fabric, especially the air permeability. Air permeability is a function of fabric density (i.e. the denser the fabric, the lesser the air permeability). The fabric density is controlled by warp end density and filling yarn (weft yarn) density for chosen yarns, weave, loom, finishing processes and other weaving conditions. For instance, a typical air bag fabric produced with a conventional reed, which is either plain or profiled, may produce a fabric with a warp end density variation across the width of the fabric as depicted in FIG. 2. There is virtually no filling yarn density variation under normal conditions. Therefore, the density variation across the width of a given fabric is caused by the variation of warp end density.

A typical prior art reed 2 is shown in FIGS. 1, 1A, where a plurality of reed wires 4 are connected at their ends to a top baulk 6 and a bottom baulk 8. The reed wires 4 are separated by spaces 10. A dent 12 comprises a wire 4 and an adjacent space 10. A conventional reed wire 4 is shown in FIG. 1B, while a profile reed wire 4' is shown in FIG. 1C.

Air permeability is a critical property of some industrial fabrics such as air bag and filtration fabrics. In the case of air bag fabrics, manufacturers have used many methods to control air permeability including the use of calendering, coatings, impregnation, special weave designs, special air bag constructions, envelopes and layers of differing air permeability, and other methods. These methods may result in: increased costs, limited recyclability in the case of coatings, increased waste, and complicated constructions. The venting of air bags through the fabric may not be possible due to variation in air permeability of the fabric and the resulting unpredictable mode of operation. An example of an air bag with vent holes is shown in U.S. Pat. No. 5,566,972 to Yoshida et al. Examples of air bags using several fabric sections with differing air permeability are seen in U.S. Pat. No. 5,375,878 to N. Ellerbrook, and U.S. Pat. No. 5,566,434 to A. W. Beasley. Another method for making air bag fabric is to utilize special yarns to weave a fabric of low air permeability obviating the need for coating or other processes, as seen in U.S. Pat. No. 5,474,836 to Nishimura et al., and U.S. Pat. No. 5,508,073 to Krummheuer et al. The present invention can improve such a fabric by providing virtually no variation of air permeability across the width of the fabric and may possibly reduce fabric waste in the process of making an air bag. The present invention can also offer an air bag fabric of variable density, which, after construction into an air bag, could result in more uniform air permeability at maximum deployment.

A non-uniform product may result, such as in the case of paper making fabrics, from variations in the fabric. Examples of paper making fabric are shown in U.S. Pat. No. 4,649,964 to R. W. Smith and U.S. Pat. No. 4,588,632 to Gisbourne et al. The present invention can provide a uniform fabric.

A fabric having a differential density is depicted in U.S. Pat. No. 4,698,276 to Duval et al., which is an example of a decorative fabric used to produce drapery. The present invention can produce a fabric which may be suitable for this usage while obviating the need for a complicated construction provided by the assemblage of strips of fabric with various fabric densities. Further, a fabric of variable densities may be suitable for an air bag fabric whereby these densities, when predetermined, could produce a controlled deflation of the air bag by, for example, utilizing a greater density where the fabric stretches more and a lesser density where the fabric stretches less to produce, in effect, less or possibly no variation in air permeability.

Reed type devices which do not perform strenuous beat-up functions are shown, for example, in U.S. Pat. No. 5,368,076 to F. H. Curzio. This reed is actually a warp guiding device but is designed to affect warp end density in net type, loosely woven type fabrics. These fabrics are intended to act as reinforced fabric for composite materials to cover three dimensional mandrels. This reed is of a different design peculiar to making net fabrics where consistent air permeability is not a factor. The reed is shaped to make fabrics for a three dimensional mandrel. Further, this reed design could not perform the functions of the present invention.

Other reed designs include reeds with adjustable or removable dents such as those depicted in U.S. Pat. No. 5,029,617 to Anderson et al. The reed of Anderson cannot correct the warp end density variation as can the present invention because of the spaced relationship of the dents. Regardless of how closely spaced the dents are made in the removable dent reed it could not offer the control of warp end variation available in the present invention. Each adjacent reed wire and removal of same in this removable dent reed would preclude providing the desired spacing needed to produce the fabrics thereby produced by the present invention. Reeds with adjustable or removable dents are utilized generally to insert a larger warp yarn, perhaps to effect a change in the appearance of a decorative fabric, provide a certain selvedge, or provide reinforcement in an industrial fabric. Further, these reeds are also employed to ease maintenance, as a damaged wire can be readily replaced. The adjustable reed may, for instance, be used to produce net shaped fabrics in a variety of shapes, as seen in U.S. Pat. No. 5,465,762 to G. L. Farley. Another type of reed is depicted in U.S. Pat. No. 5,158,116 to Kazuo et al., whereby the dent spacing varies to accommodate thick yarns to facilitate the weaving process.

BRIEF SUMMARY OF THE INVENTION

The present invention relates to weaving devices having weaving elements such as reeds, discs, and lamellae or similar functioning elements. These devices may include conventional reeds, rotary reeds, and weaving rotors such as those used on multiple shed looms. More particularly, the present invention relates to a weaving reed with a construction such that warp end density variation is controlled, or the warp end density can be changed, across the entire width of a fabric. Furthermore, the present invention will affect the mechanical properties of the fabric. One embodiment of this invention and a quality of such a fabric thereby produced includes virtually no variation of air permeability across the entire width of the finished fabric. Alternatively, other embodiments of this invention may produce changes in warp end density of a given fabric depending on reed dent spacing or dent group spacings chosen for a desired effect. The present invention, utilizing a reed of variably spaced dents, will be of use in any application requiring a fabric with virtually no variation, or to produce a desired predetermined change, in warp end density. A fabric produced by the present invention with this reed is suitable, in particular, for an uncoated air bag fabric. The present invention can also offer a new fabric which is comprised of different warp end densities in selected areas of the fabric which can alternatively be of service to, for example, air bag fabric assemblies.

DESCRIPTION OF THE DRAWINGS

FIG. 19 is a schematic perspective view of another embodiment of the present invention having a rotary type reed.

FIG. 20 is a schematic representation of the embodiment of FIG. 19.

DETAILED DESCRIPTION OF THE INVENTION

Accordingly, one embodiment of the present invention is to provide a weaving reed which can produce improved fabrics by controlling the variation of warp end density across the entire width of the finished fabric. However, a thorough study of the variation of warp end density across the width of the finished fabric produced by a conventional fixed dent reed of the prior art (see FIGS. 1–1C, 2, 3), is vital to the successful implementation of this invention in a given fabric.

Figure 1:
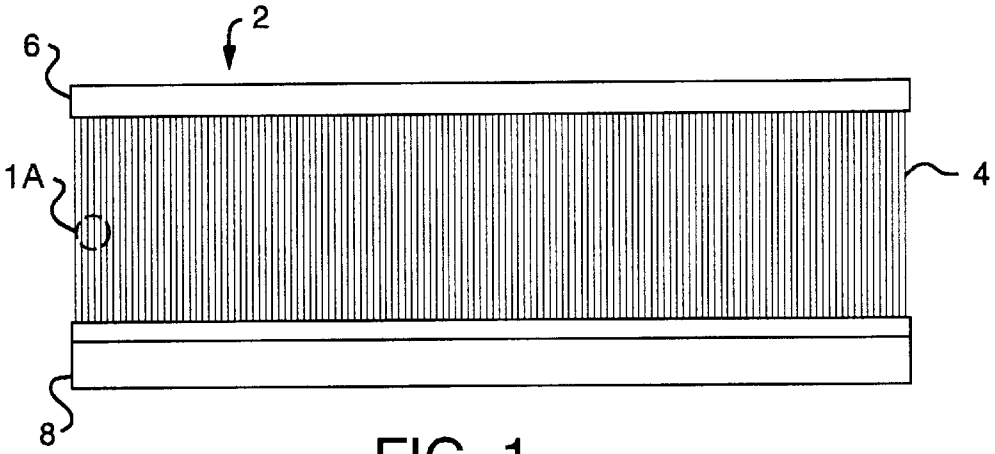
FIG. 1 PRIOR ART
FIG. 1 is a schematic plan view of a conventional reed of the of prior art with fixed dent spacings.
Figure 1C:
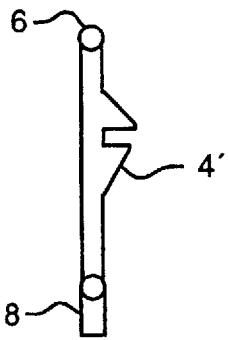
FIG. 1C PRIOR ART
FIG. 1C is a schematic side elevation view of a profile reed wire of the reed of FIG. 1.
Figure 1B:
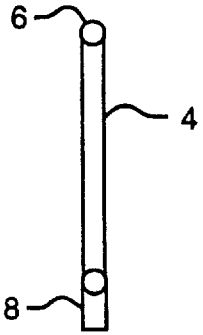
FIG. 1B PRIOR ART
FIG. 1B is a schematic side elevation view of a plain reed wire of the reed of FIG. 1.
Figure 1A:
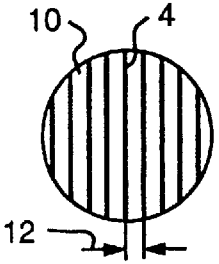
FIG. 1A is a schematic enlarged plan view of a portion of the reed wires and spaces of the reed of FIG. 1.
Figure 2:
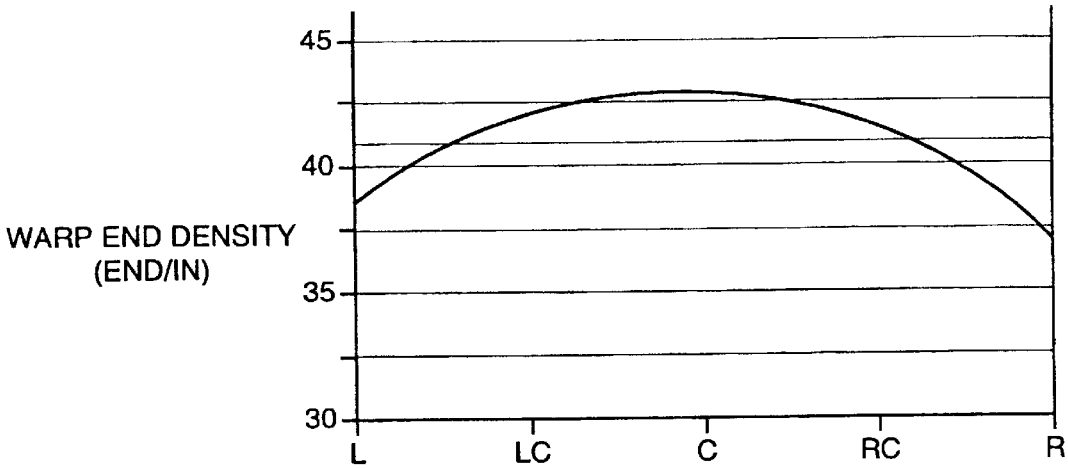
FIG. 2 PRIOR ART
FIG. 2 is a schematic graphical representation of the warp end density variation across the width of a typical prior art woven air bag fabric.
Figure 3:
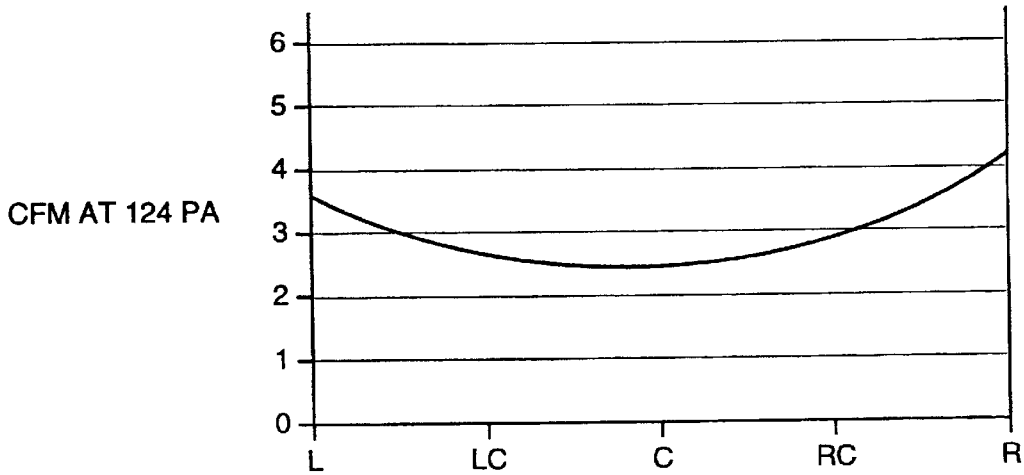
FIG. 3 PRIOR ART
FIG. 3 is a schematic graphical representation of the air permeability across the width of the prior art woven air bag fabric of FIG. 2.

FIGS. 2 and 3 depict a typical prior art woven fabric, for example, an air bag fabric of 630 denier high-tenacity nylon yarn with a nominal density of 41×41 ends/inch. The actual warp end density across the width of the prior art fabric is shown by the curve depicted in FIG. 2. In this example the warp end density of the fabric is about 42.7 ends/inch at the middle of the fabric while only about 37.5 ends/inch at the edges of the fabric. This warp end density will give this fabric the air permeability variation across the width of the fabric following the curve depicted in FIG. 3, showing the air-permeability at the middle of the fabric to be about 2.5 cfm (at 124 Pascals) while it is about 4 cfm (at 124 Pascals) towards the edges.

Figure 6:
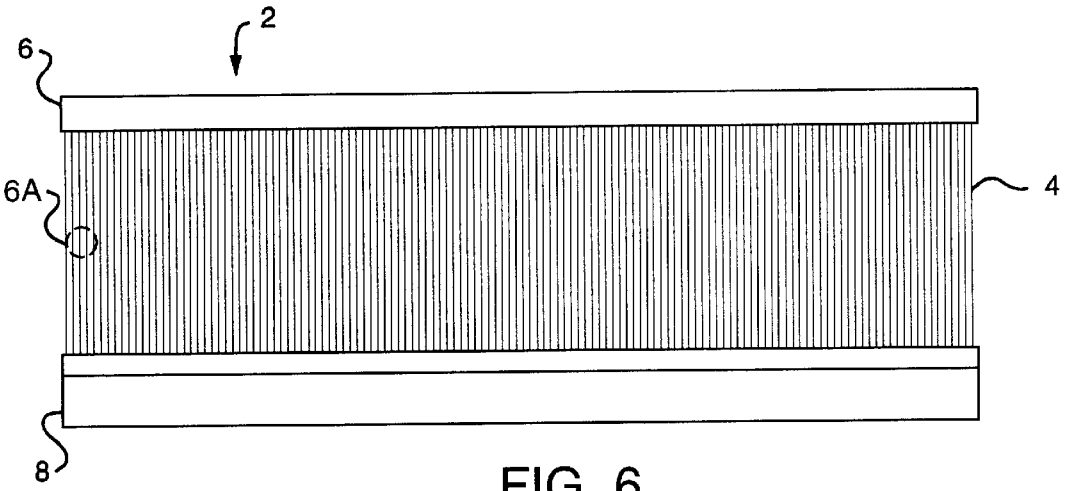
FIG. 6 is a schematic plan view of one embodiment of a reed according to the present invention.
Figure 6A:
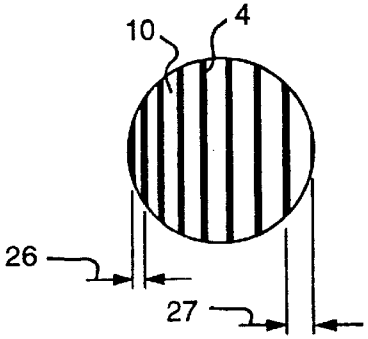
FIG. 6A is a schematic enlarged plan view of a portion of the reed wires and spaces of the reed of FIG. 6.
Figure 7:
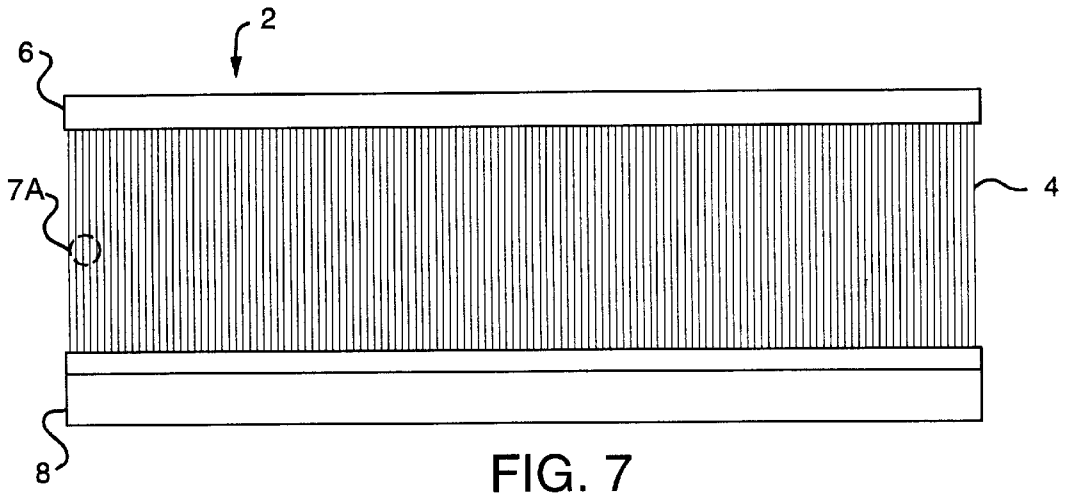
FIG. 7 is a schematic plan view of another embodiment of a reed according to the present invention.
Figure 7A:
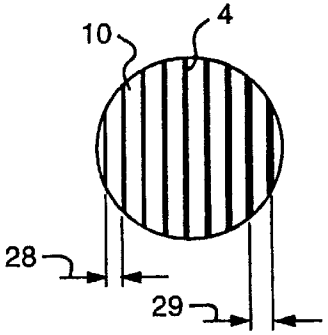
FIG. 7A is a schematic enlarged plan view of a portion of the reed wires and spaces of the reed of FIG. 7.
Figure 8:
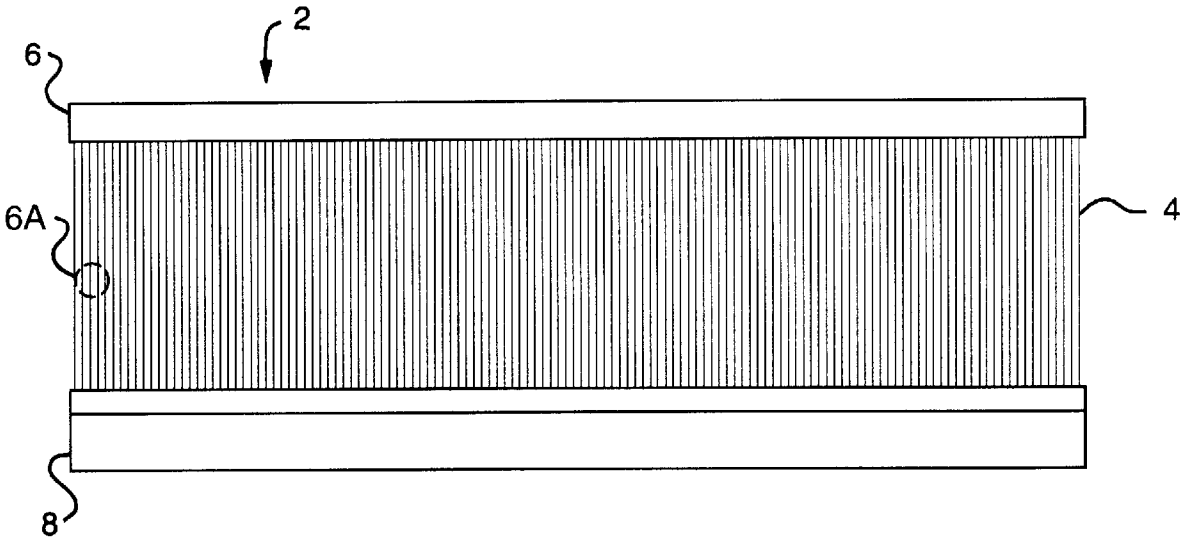
FIG. 8 is a schematic plan view of another embodiment of a reed according to the present invention.
Figure 8A:
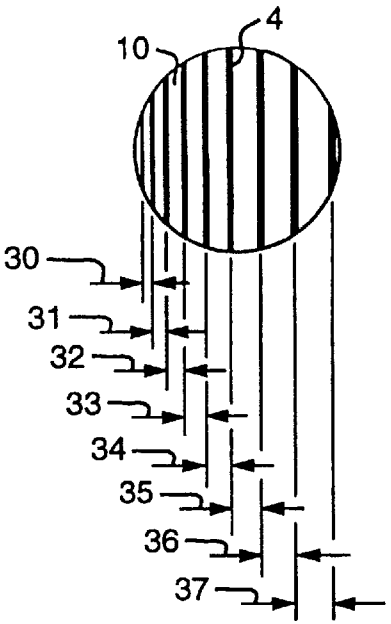
FIG. 8A is a schematic enlarged plan view of a portion of the reed wires and spaces of the reed of FIG. 8.

One preferred embodiment of this invention, while not limited to any particular beat-up type reed construction or gauge (also called pitch or count and measured in dents/inch), is a plain reed, or a reed having any profile or functional equivalents, for use on virtually any type of loom, which is comprised of reed elements having variable dent spacing where required, that can be accomplished by the following example constructions. The present invention can have reed elements such as fixed wires and variable spaces between the wires to achieve variably spaced dents, as seen in FIGS. 6, 6A. Alternatively, the present invention can have fixed spaces between wires and variable wire thicknesses to achieve variably spaced dents, as seen in FIGS. 7, 7A. Yet alternatively, the present invention may have a combination of variable spaces between wires and variable wire thicknesses to achieve variably spaced dents, as seen in FIGS. 8, 8A. Functional equivalents such as rotary reeds and weaving rotors may have related parts that require adjustment to achieve the new spacings provided by the constructions described in this disclosure. The aforementioned constructions of the present invention, in certain preferred embodiments, produce a finished fabric with virtually consistent warp end density across the width of the fabric. In effect the variation of warp end density across the width of the finished fabric is adjusted for during weaving by the present invention.

To correct the variation of warp end density across the width of the prior art fabric shown in FIG. 2, the present invention is designed with variable dent spacing along the entire length of the reed. The reed gauge in dents per inch is depicted graphically in FIG. 4. The reed gauge at both ends of the reed is about 42.5 dents/inch based on a dent spacing (which is the thickness of one wire plus the width of one adjacent space) of about 0.0235 inches. The middle of the reed has a dent spacing of about 0.0282 inch, producing a reed gauge of about 35.5 dents/inch. Such a reed will produce a fabric with consistent warp end density which will give this fabric a uniform air permeability across the width of the fabric following the curve depicted in FIG. 5. Possible constructions to achieve this variable dent spacing are depicted in FIGS. 6–8.

Figure 4:
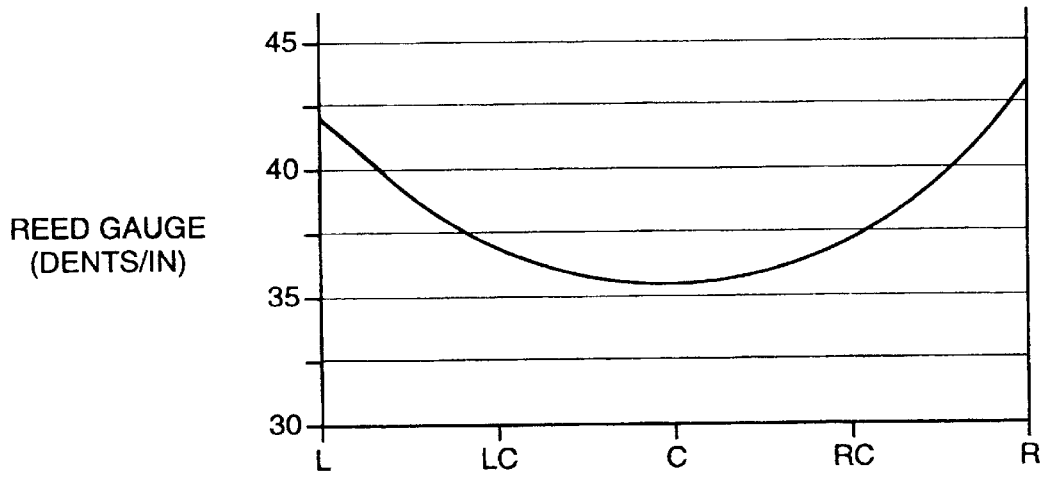
FIG. 4 is a schematic graphical representation of the dent spacing measured by reed gauge across a reed according to the present invention.
Figure 5:
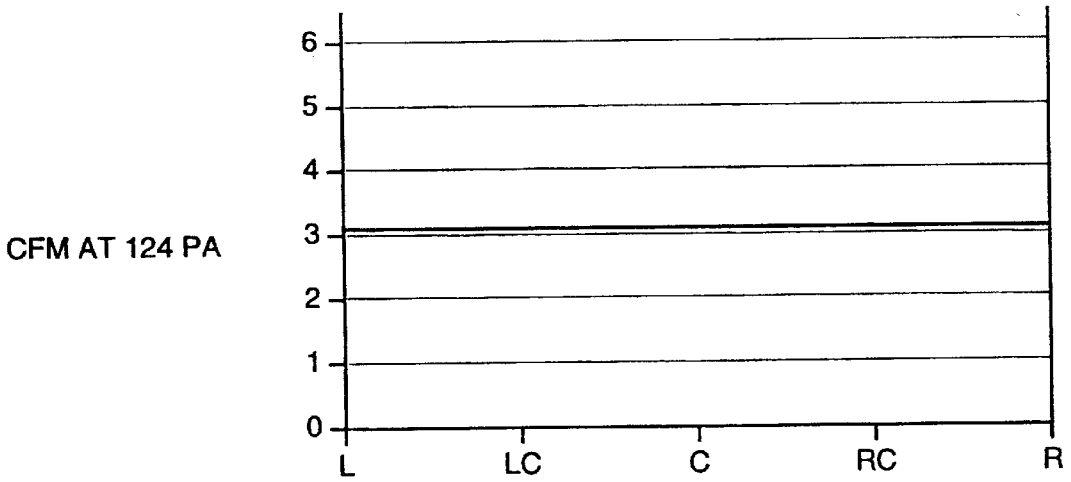
FIG. 5 is a schematic graphical representation of the air permeability across the width of a fabric woven using the reed having the dent spacing of FIG. 4.

FIG. 6A is an enlarged view showing the first 8 dents from the left selvedge of the reed 2 of FIG. 6. The embodiment shown in FIGS. 6, 6A shows variable dent spacings which are achieved by having wires 4 of fixed thickness (for this example wires 4 have a thickness of 0.0100 inch), and spaces 10 of a variable width. The space 10 in first dent 26 is 0.0135 inches wide which will provide a total dent spacing for dent 26 of 0.0235 inch. The space 10 between adjacent wires 4 is increased by 0.0001 inch increments progressively along reed 2 to a maximum amount at a desired point, from which spaces 10 begin to decrease by the same amount, which is illustrated more clearly in the graph of FIG. 4 showing the reed gauge resulting from this dent spacing. Space 10 between wires 4 at the eighth dent 27 is 0.0142 inch which will give a total dent spacing for eighth dent 27 of 0.0242 inch.

Another embodiment is depicted in FIGS. 7, 7A, where a reed 2 of the present invention is shown with variable dent spacings achieved by having fixed spaces 10 (0.0135 inch in this example) between adjacent wires 4 which have varying wire thicknesses. In the illustrated embodiment, the thickness of wire 4 in the first dent 28 is about 0.0100 inch. This will give a total dent spacing for first dent 28 of 0.0235 inch. Similarly to FIGS. 6, 6A, the thickness of wires 4 is increased by 0.0001 inch increments progressively along reed 2 to a maximum thickness at a desired point from which the thickness begins to decrease at the same rate. The actual wire thickness at the eighth dent 29 is 0.0107 inch which will give a total dent spacing for eighth dent 29 of 0.0242 inch.

FIGS. 8, 8A depict another embodiment of a reed of the present invention with variable dent spacings achieved by combining variable wire 4 thicknesses and variable space 10 widths. The construction dimensions of the first eight dents are as follows: First dent 30 has a wire 4 thickness of 0.0103 inch, and a space 10 width of 0.0132 inch, for a total dent spacing for first dent 30 of 0.0235 inch. Second dent 31 has a wire 4 thickness of 0.0100 inch and a space 10 width of 0.0136 inch, for a total dent spacing for second dent 31 of 0.0236 inch. Third dent 32 has a wire 4 thickness of 0.0100 inch and a space 10 width of 0.0137 inch, for a total dent spacing for third dent 32 of 0.0237 inch. Fourth dent 33 has a wire 4 thickness of 0.0104 inch and a space 10 width of 0.0134 inch, for a total dent spacing for fourth dent 33 of 0.0238 inch. Fifth dent 34 has a wire 4 thickness of 0.0105 inch and a space 10 width of 0.0134 inch, for a total dent spacing for fifth dent 34 of 0.0239 inch. Sixth dent 35 has a wire 4 thickness of 0.0106 inch and a space 10 width of 0.0134 inch, for a total dent spacing for sixth dent 35 of 0.0240 inch. Seventh dent 36 has a wire 4 thickness of 0.0104 inch and a space 10 width of 0.0137 inch, for a total dent spacing for seventh dent 36 of 0.0241 inch. Eighth dent 37 has a wire 4 thickness of 0.0107 inch and a space 10 width of 0.0135 inch, for a total dent spacing for eighth dent 37 of 0.0242 inch. The aforementioned dimensions are shown purely for illustrating the workings of the present invention and must be adjusted according to the desired result in a given fabric. The aforementioned example reed dent dimensions almost perfectly correct the curve depicted in FIG. 2.

Figure 9:
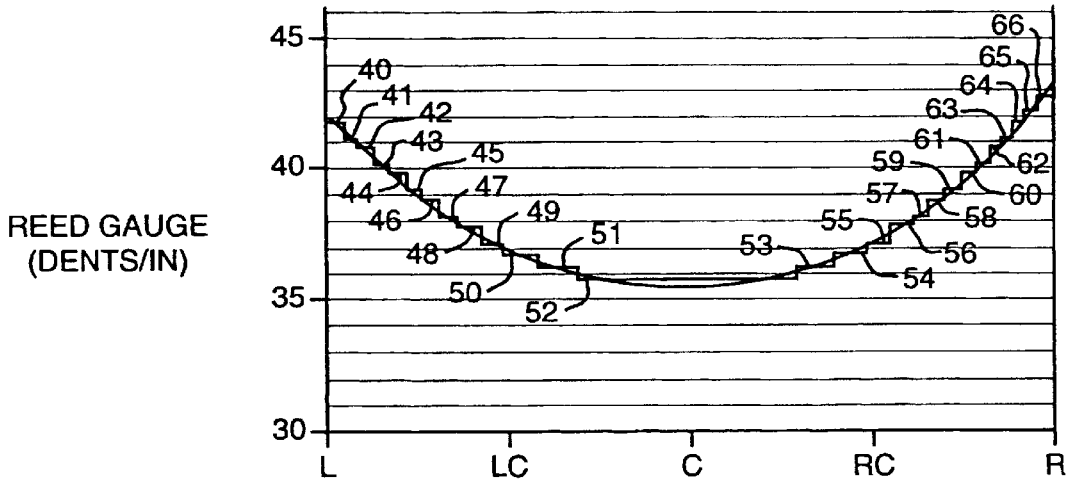
FIG. 9 is a schematic graphical representation of another embodiment of a reed according to the present invention showing the spacing of dent groups along the length of the reed as depicted in FIG. 4.

The present invention can be simplified as depicted in FIG. 9, which graphically represents the reed gauge in dents/inch across the width of a fabric of a reed of another preferred embodiment of the present invention having dent groups. In this embodiment, the entire length of the reed is divided into 27 groups of dents, i.e. a wire 4 and a space 10, where the dent spacing of each dent in a group is the same but different from the spacing of the dents of at least its adjacent groups. While the result will not be as perfect as what may be achieved with the reeds depicted in the embodiments of FIGS. 6, 6A, 7, 7A, or 8, 8A, it will serve well for most practical purposes. The specific dent spacings of the groups of this embodiment are as follows: dent group 40 is 0.0240 inch, dent group 41 is 0.0242 inch, dent group 42 is 0.0245 inch, dent group 43 is 0.0248 inch, dent group

44 is 0.0252 inch, dent group 45 is 0.0255 inch, dent group 46 is 0.0258 inch, dent group 47 is 0.0261 inch, dent group 48 is 0.0265 inch, dent group 49 is 0.0268 inch, dent group 50 is 0.0272 inch, dent group 51 is 0.0276 inch, dent group 52 is 0.0280 inch, dent group 53 is 0.0276 inch, dent group 54 is 0.0272 inch, dent group 55 is 0.0268 inch, dent group 56 is 0.0265 inch, dent group 57 is 0.0261 inch, dent group 58 is 0.0258 inch, dent group 59 is 0.0255 inch, dent group 60 is 0.252 inch, dent group 61 is 0.0248 inch, dent group 62 is 0.0245 inch, dent group 63 is 0.0242 inch, dent group 64 is 0.240 inch, dent group 65 is 0.0237 inch, and dent group 66 is 0.0234 inch.

Figure 10:
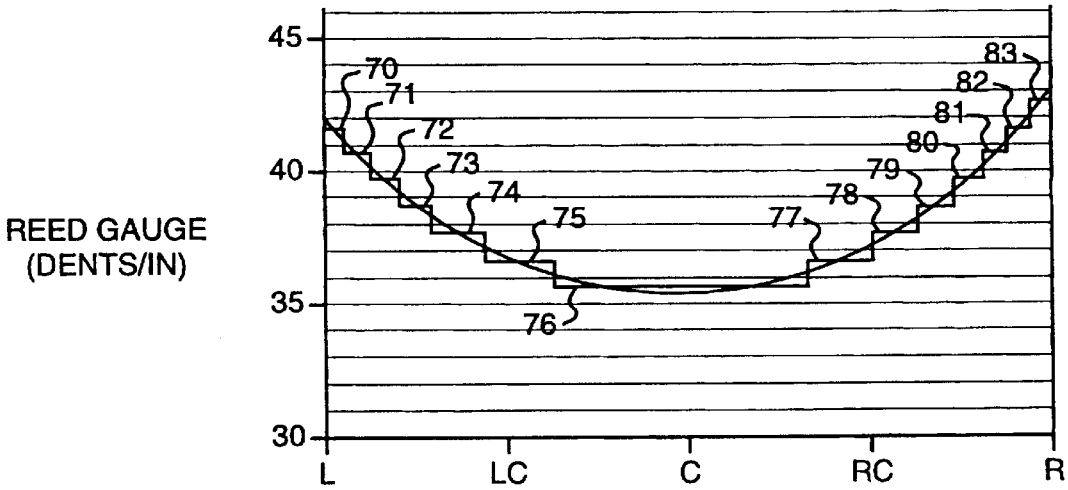
FIG. 10 is a schematic graphical representation of another embodiment of a reed according to the present invention showing the spacing of dent groups along the length of the reed as depicted in FIG. 4.

The present invention can be simplified yet further with other groupings of dents as depicted in the embodiment of FIG. 10. In this embodiment the entire length of the reed is divided into 14 groups of dents. In a manner similar to the embodiment of FIG. 9, the spacing of the dents within each group is the same, but the spacing of each group is different from at least its adjacent groups: Dent group 70 is 0.0240 inch, dent group 71 is 0.0245 inch, dent group 72 is 0.0252 inch, dent group 73 is 0.0258 inch, dent group 74 is 0.0265 inch, dent group 75 is 0.0272 inch, dent group 76 is 0.0280 inch, dent group 77 is 0.0272 inch, dent group 78 is 0.0265 inch, dent group 79 is 0.0258 inch, dent group 80 is 0.0252 inch, dent group 81 is 0.0245 inch, dent group 82 is 0.0240 inch, and dent group 83 is 0.0234 inch.

Both of the simplified reeds depicted in FIGS. 9, 10 can be designed by varying the weaving element thickness, that is, the reed wire, rotary reed disc, or lamellae in a weaving rotor thickness, or varying space widths or a combination of these two. Such variable wire thicknesses and spacing widths need not necessarily be variable entirely across the length of the reed in order to provide a certain amount of warp end density variation correction. Rotary reeds and weaving rotors may have related parts used in conjunction with same which must be adjusted to match new spacings provided by the constructions described in this disclosure. To correct greater variation in warp end density of the finished fabric one may use smaller groupings of dents (i.e. fewer dents per group). To correct smaller variations in the warp end density of the finished fabric one may use larger groupings (i.e. more dents per group). Ideally, groupings of dents are adjusted such that the warp end density curve is matched closely enough for practical usage of the finished fabric. Matching the warp end density curve precisely is not necessary for most applications as a rough match to the curve will provide adequate correction.

As a rule, the simpler the design (fewer number of groupings), the less able the present invention will be able to correct the variation of warp end density across the width of the finished fabric. Therefore a thorough understanding of the actual variation of warp end density of any finished fabric and its end use application will determine the complexity of the present invention.

Figure 11:
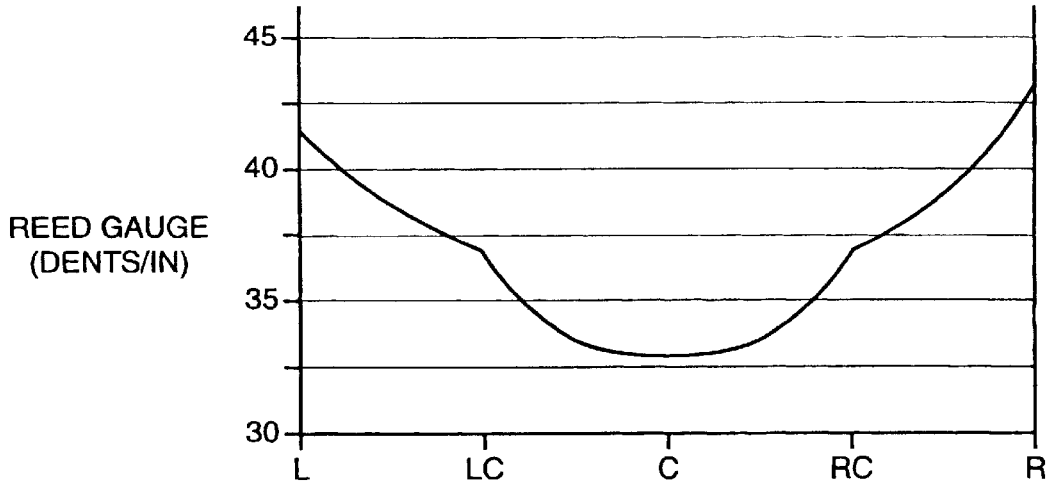
FIG. 11 is a schematic graphical representation of dent spacing for a reed according to one embodiment of the present invention which produces a non-uniform air permeability across the width of a fabric.
Figure 12:
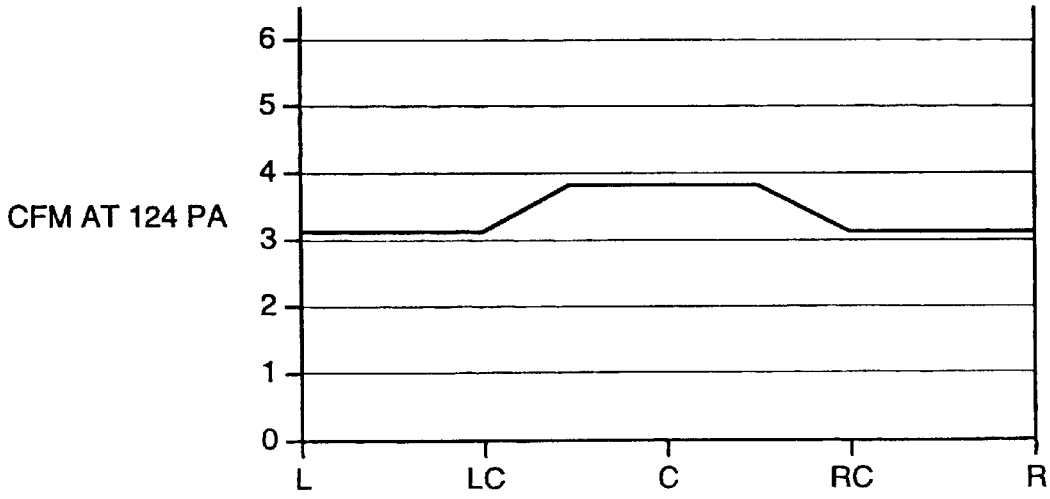
FIG. 12 is a schematic graphical representation of the air permeability across the width of a fabric using the dent spacing of FIG. 11.

The present invention can also produce a fabric having a non-uniform air permeability. Another embodiment of the present invention is depicted in FIG. 11, which shows the reed gauge distribution for a reed which produces a fabric having a non-uniform air permeability distribution as shown in FIG. 12. As can be seen, the distribution for this embodiment comprises three segments of uniform air permeability, with transition segments of non-uniform air permeability between adjacent segments. The two segments at the outer edges, that is, the left and right portions, of the fabric have an air permeability lower than the third segment, that is, the central portion, and substantially equal to one another. The central portion, of the fabric has a constant air permeability which is higher than the two segments at the outer edges. There are two transition segments, each having a sloped distribution of air permeability between an outer segment and the center portion segment.

Figure 13:
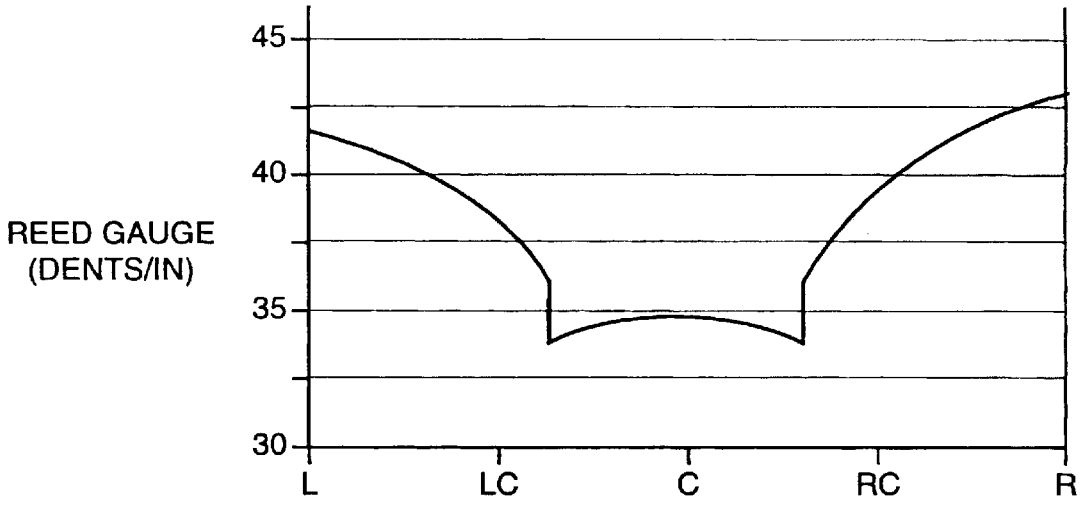
FIG. 13 is a schematic graphical representation of dent spacing for a reed according to another embodiment of the present invention which produces a non-uniform air permeability across the width of a fabric.
Figure 14:
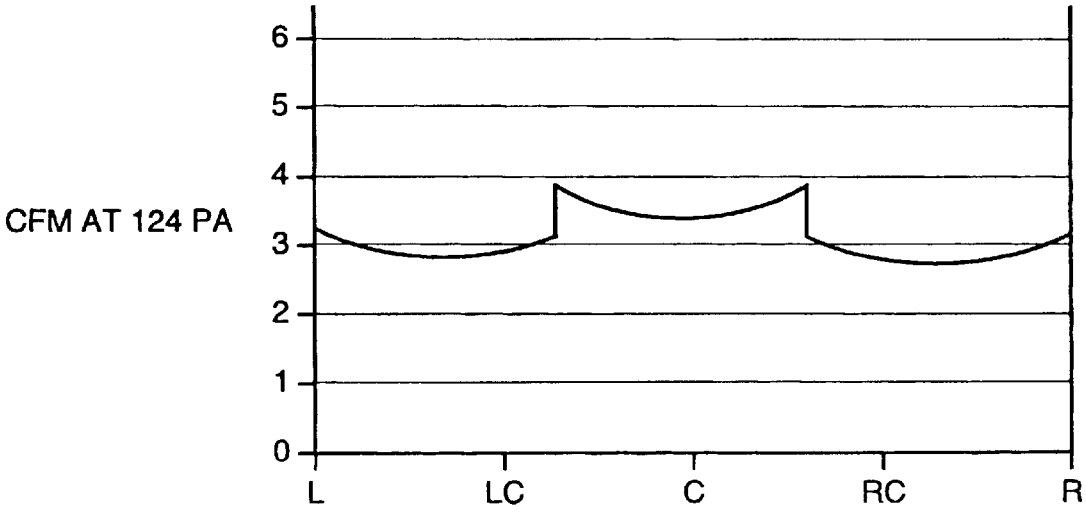
FIG. 14 is a schematic graphical representation of the air permeability across the width of a fabric using the dent spacing of FIG. 13.

The embodiment depicted in FIG. 13 shows the reed gauge distribution for a reed which produces a fabric having a non-uniform air permeability distribution as shown in FIG. 14. As can be seen, this distribution comprises three major segments having curved, or substantially shallow U-shaped, distributions with sharp transitions, or breaks, between each segment. The outer segments have a generally lower air permeability than the central segment, with the lowest air permeability being at the center of the segments and the greatest air permeability at the outer edges of the segments. The central segment as well as its lowest air permeability at its center and its greatest air permeability at its outer edges.

Figure 15:
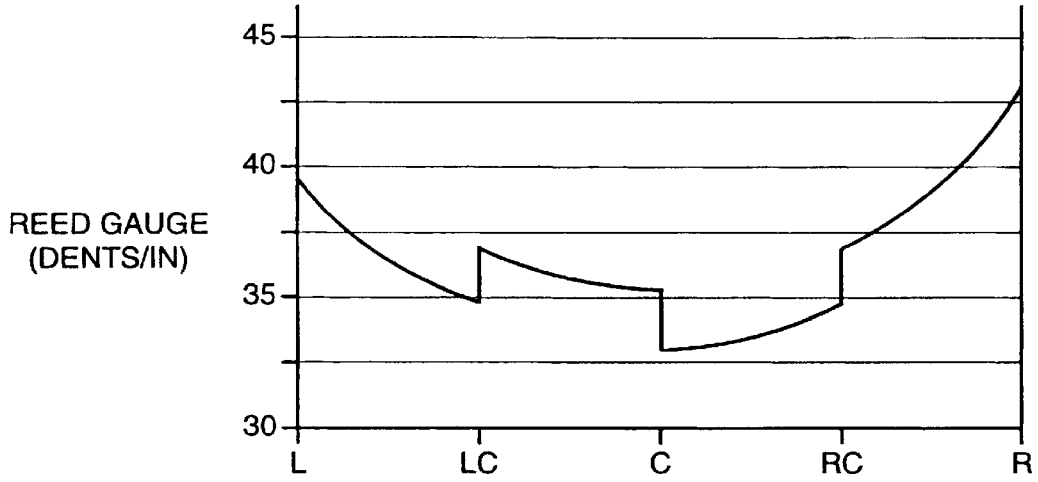
FIG. 15 is a schematic graphical representation of dent spacing for a reed according to another embodiment of the present invention which produces a non-uniform air permeability across the width of a fabric.
Figure 16:
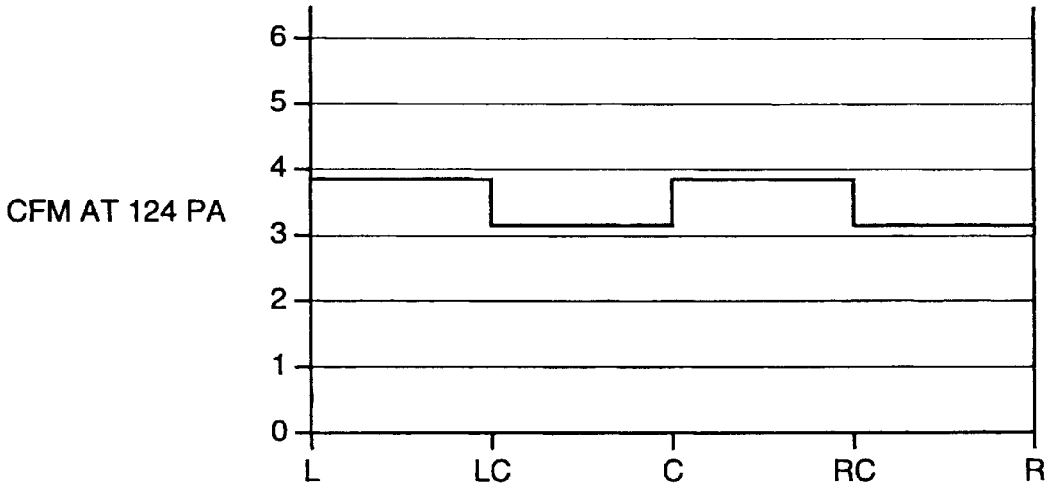
FIG. 16 is a schematic graphical representation of the air permeability across the width of a fabric using the dent spacing of FIG. 15.

The embodiment depicted in FIG. 15 shows the reed gauge distribution for a reed which produces a fabric having a non-uniform air permeability distribution as shown in FIG. 16. The air permeability of this embodiment follows a step curve, with alternating segments of higher then lower air permeability.

Figure 17:
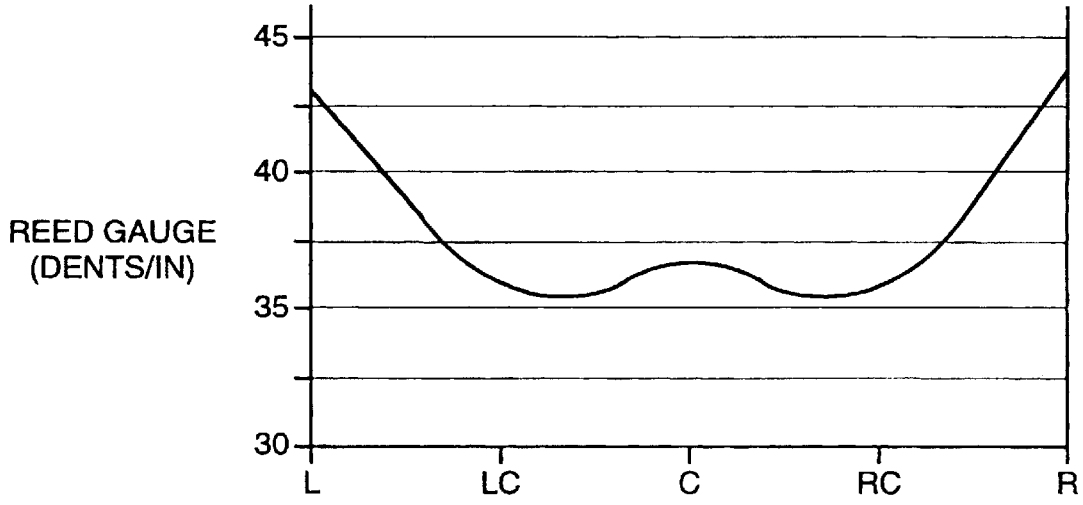
FIG. 17 is a schematic graphical representation of dent spacing for a reed according to another embodiment of the present invention which produces a non-uniform air permeability across the width of a fabric.
Figure 18:
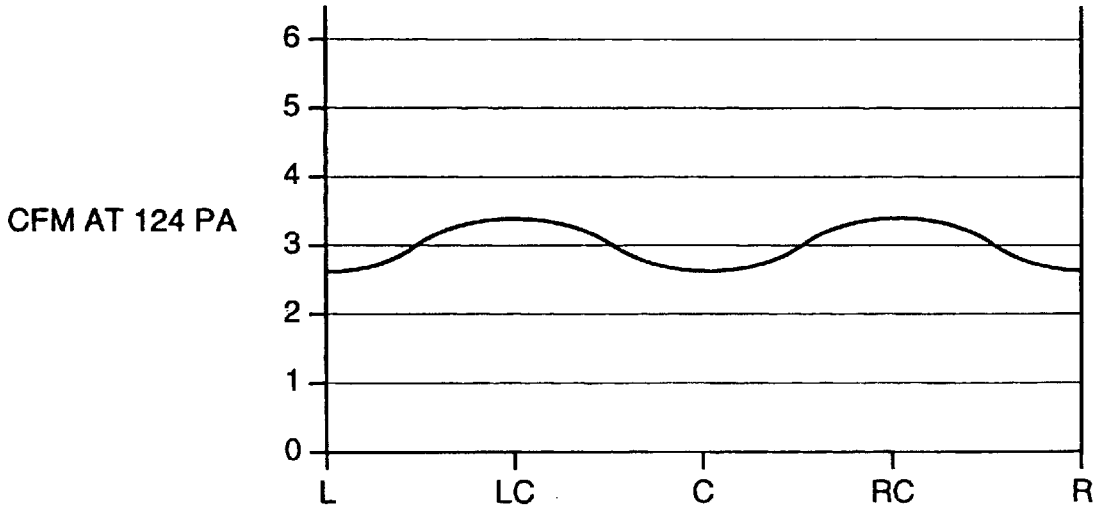
FIG. 18 is a schematic graphical representation of the air permeability across the width of a fabric using the dent spacing of FIG. 17.

The embodiment depicted in FIG. 17 shows the reed gauge distribution for a reed which produces a fabric having a non-uniform air permeability distribution as shown in FIG. 18. The air permeability of this embodiment follows a sinuous curve, where the distribution of air permeability undulates from higher to lower to higher air permeability.

The specific dent spacings required for the embodiments of FIGS. 11–18 are not shown here as it would be impractical due to the number required. However, sufficient detail is shown here, in combination with the discussion above with respect to the reeds which produce a uniform air permeability, to enable one skilled in the art to construct reeds having these characteristics. The curves depicted in these graphs were derived from the curve shown in FIG. 3. The dimensions utilized for these variable spaced reeds and their effect on the air permeability across the width of the fabric are shown purely for illustrating the workings of the present invention and must be adjusted according to the desired result in a given fabric.

Disc thickness and the space between two discs on a rotary reed and lamellae thicknesses of weaving rotors and related parts for multiple-shed weaving machines can be designed according to the teachings provided herein to produce fabrics with uniform warp end density—or for a desired effect, across the width of a finished fabric.

Another embodiment of the present invention having a rotary reed is shown in perspective view in FIG. 19 and in plan view in FIG. 20. Reed 2' has stationary reed wires 4" separated by spaces 10 and a rotary reed 14. Rotary reed 14 comprises shaft 16 supporting discs 18 which are separated by spaces 10'. Dents 12 are formed of a reed wire 4" and a space 10, while dents 12' are formed of a disc 18 and a space 10'. Reed 2' could, when modified in a similar manner described herein form a fabric having a desired warp end density. In a manner similar to that described above with respect to FIGS. 6–8, the dent spacing can be made non-uniform by varying the thickness of reed wires 4" and discs 18, the width of spaces 10, 10', or a combination of the two. A detailed example is not needed herein as the examples illustrated above with respect to FIGS. 6–8 are sufficient to demonstrate the principle with respect to this embodiment.

Figure 21:
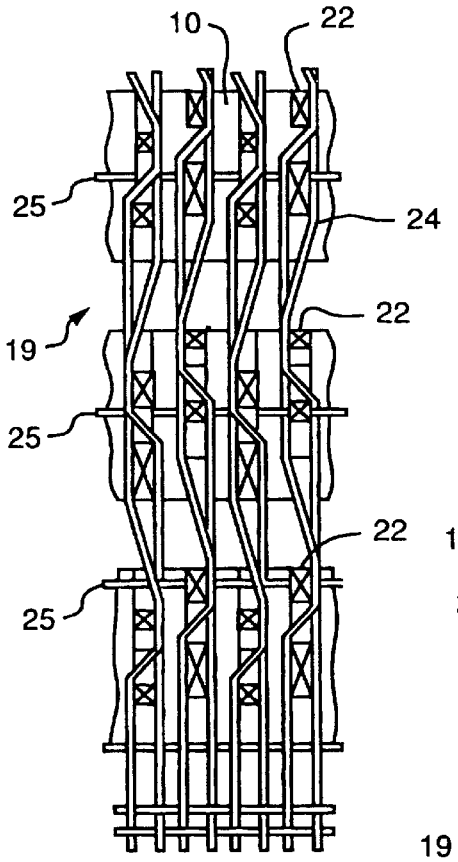
FIG. 21 is a schematic plan view of another embodiment of the present invention having a weaving rotor.
Figure 22:
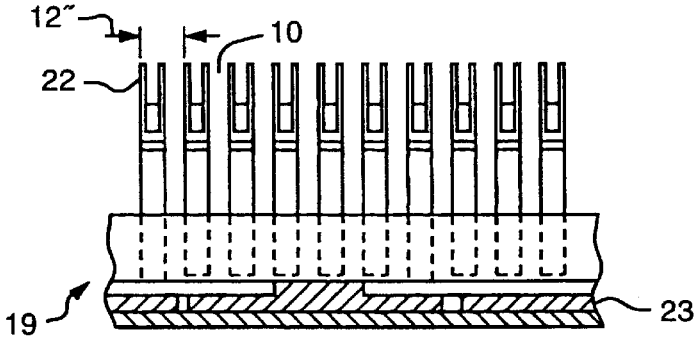
FIG. 22 is a schematic front elevation view of the weaving rotor of FIG. 21.
Figure 23:
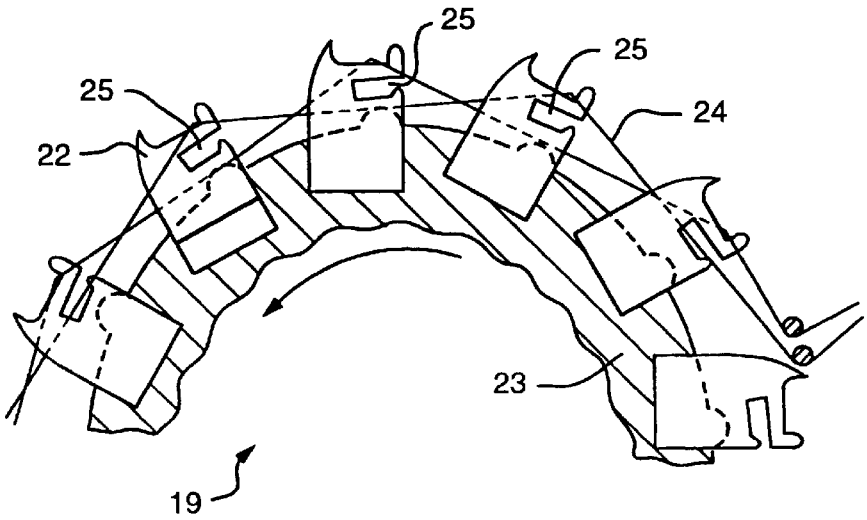
FIG. 23 is a schematic side elevation view of the weaving rotor of FIG. 21.

Another embodiment of the present invention having a weaving rotor is shown in FIGS. 21–23. Weaving rotor 19 has a plurality of lameliae 22 separated by spaces 10 and supported on rotor 23. Dents 12" are formed of a lamella 22 and a space 10. Warp ends 24, and filling yarn (weft yarn) 25, as seen in FIG. 23, run through lamellae 22. In a manner similar to that described above with respect to FIGS. 6–8, the dent spacing can be made non-uniform by varying the thickness of lamellae 22, the width of spaces 10 or a combination of the two. A detailed example is not needed herein as the examples illustrated with respect to FIGS. 6–8 are sufficient to demonstrate the principle with respect to this embodiment.

It is an established practice in the art of weaving to draw different number of warp ends through a dent. For example, one end per dent, two ends per dent, three ends per dent, etc. Another practice is to skip every other dent, e.g. skip one dent in two, skip one dent in three, two dents in three, two dents in four, etc. Therefore, this practice, when applied to the present invention, will produce a uniform fabric, although warp end density will be different in accordance with how many warp ends are inserted through each of the dents. Regardless of this practice, it is still possible with the present invention to produce a uniform air permeability over a given area due to the uniformity of the finished fabric. The present invention with the reeds illustrated herein, or a rotary reed and its related parts, or a weaving rotor and its related parts for multiple shed looms, utilizing the principles of these constructions, with spacings and/or wire (or disc or lamellae) thicknesses appropriate for the given yarn and conditions, can be utilized to accommodate for this practice.

Any change in yarns, weaves, weaving conditions, finishing processes and conditions will affect the warp end density distribution across the entire width of the finished fabric. Therefore, any such change requires a thorough study on the warp end density distribution across the entire width of the finished fabric. The result of this study is required to design the appropriate variably spaced dent(s) reed by using variable wire (or disc and related parts as in the case of a rotary reed or lamellae and related parts for a weaving rotor) thickness and/or variable space between wires (or discs or lamellae, and related parts), to adjust for the change. Rotary reeds and weaving rotors may have related parts used in conjunction with the same which must be adjusted to match new spacings provided by the constructions described in this disclosure.

Clearly, many permutations of the present invention are made possible in the review of the above teachings. It is therefore to be understood that within the scope of the appended claims the invention may be practiced otherwise than as specifically described. It is understood herein that the term wire used to describe the member used in conjunction with a space to comprise a dent, may be member(s) of other material or materials. These wires, if of sufficient strength to endure beat-up without support on both the top and bottom, may preclude the need for either a top or bottom baulk. Rotary reeds and weaving rotors may have related parts used in conjunction with same which must be adjusted to match new spacings provided by the constructions described in this disclosure.

I claim:

1. A device for weaving a fabric, comprising:

a plurality of weaving elements comprising reed wires, each weaving element being separated from adjacent weaving elements by a space;

a plurality of dents, each dent comprising a weaving element and an adjacent space, with at least one of the dents having a width different from the width of the other dents by a width of at least one reed wire being different from at least one other reed wire, and with a finished fabric woven on the device having a substantially uniform air permeability within predetermined discrete portions of the width of the finished fabric.

2. The device in accordance with claim 1, wherein each space has substantially the same width as each of the other spaces.

3. The device in accordance with claim 1, wherein at least one space is of a different width than at least one other space.

4. The device in accordance with claim 1, further comprising a plurality of dent groups, each dent group comprising a plurality of reed wires and corresponding spaces, the width of each dent in a dent group being substantially the same as the width of the other dents in the group and different from the width of the dents of at least one of the other dent groups.

5. A device for weaving a fabric, comprising:

a plurality of weaving elements comprising discs, each weaving element being separated from adjacent weaving elements by a space;

a plurality of dents, each dent comprising a weaving element and an adjacent space, with at least one of the dents having a width different from the width of the other dents, and with a finished fabric woven on the device having a substantially uniform air permeability within predetermined discrete portions of the width of the finished fabric.

6. The device in accordance with claim 5, wherein each disc has substantially the same thickness as each of the other discs, and at least one space is of a different width than at least one other space.

7. The device in accordance with claim 5, wherein each space has substantially the same width as each of the other spaces, and at least one of the discs has a thickness different from the thickness of at least one other disc.

8. The device in accordance with claim 5, wherein at least one space is of a different width than at least one other space and at least one of the discs has a thickness different from the thickness of at least one other disc.

9. The device in accordance with claim 5, further comprising a plurality of dent groups, each dent group comprising a plurality of discs and corresponding spaces, the width of each dent in a dent group being substantially the same as the width of the other dents in the group from the width of the dents of a least one of the other dent groups.

10. A device for weaving a fabric, comprising:

a plurality of weaving elements comprising lamellae, each weaving element being separated from adjacent weaving elements by a space;

a plurality of dents, each dent comprising a weaving element and an adjacent space, with the lamella of a dent having substantially the same thickness as each of the lamellae, and with at least the space of one dent having a different width than at least one other space of a dent so that at least one of the dents has a width different from the width of the other dents, and with a finished fabric woven on the device having a substantially uniform air permeability within predetermined discrete portions of the width of the finished fabric.

11. A device for weaving a fabric, comprising:

a plurality of weaving elements comprising lamellae, each weaving element being separated from adjacent weaving elements by a space;

a plurality of dents, each dent comprising a weaving element and an adjacent space, with at least one lamella of a dent having a thickness different from the thickness of at least one other lamella, and with at least the space of one dent having a different width than at least one other space of a dent so that at least one of the dents has a width different from the width of the other dents, and with a finished fabric woven on the device having a substantially uniform air permeability within predetermined discrete portions of the width of the finished fabric.

* * * * *